US006176730B1

(12) United States Patent
Wang et al.

(10) Patent No.: US 6,176,730 B1
(45) Date of Patent: Jan. 23, 2001

(54) ELECTRICAL CONNECTION CABLE AND MANUFACTURING METHOD THEREOF

(75) Inventors: Wei-Chuan Wang; Ping-Sheng Su, both of Tu-Chen (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/327,946

(22) Filed: Jun. 8, 1999

(30) Foreign Application Priority Data

Sep. 29, 1998 (TW) ..... 87116200

(51) Int. Cl.[7] ..... H01R 4/24

(52) U.S. Cl. ..... 439/393; 439/403; 439/402

(58) Field of Search ..... 439/439, 402, 439/403, 404, 393; 28/835, 874, 876, 828, 745, 746, 747, 748, 749

(56) References Cited

U.S. PATENT DOCUMENTS 4,133,594 * 1/1979 Laverick et al. ..... 339/95 D
4,564,254 * 1/1986 Van Alst ..... 439/403
5,069,638 * 12/1991 Schalk ..... 439/439

* cited by examiner

*Primary Examiner*—Paula Bradley
*Assistant Examiner*—Alexander Gilman
(74) *Attorney, Agent, or Firm*—Wei Te Chung

(57) ABSTRACT

An electrical connection cable manufacturing method includes the steps of (1) providing a first insulator defining a plurality of channels for receiving and retaining conductive pins, a tail section of each pin having a sharpened edge; (2) providing a second insulator defining a plurality of channels each receiving a leading end of an electrical wire, each channel having a slot communicating therewith; and (3) bringing the first and second insulators toward each other whereby the tail ends of the pins are inserted into the corresponding slots of the channels of the second insulator and the sharpened edge of each pin cuts through an insulative sheath of the wire to electrically engage a conductive core thereof. An electrical connection cable manufactured from the above-described steps comprises a positive displacement connection between the sharpened edge of the conductive pin and the conductive core of the wire thus soldering is not required.

1 Claim, 4 Drawing Sheets

ELECTRICAL CONNECTION CABLE AND MANUFACTURING METHOD THEREOF

BACKGROUND OF THE INVENTION

1. Field of the Invention

The present invention generally relates to an electrical connection cable manufacturing method, and in particular to a method for manufacturing an electrical cable that connects electrical wires to conductive terminals by insulation displacement technique.

2. The Prior Art

Computers are now widely used in all facets of society. Data transferred to/from computer based devices is usually accomplished by means of connection cables. The connection cables usually comprise a length of electrical cable comprising a number of electrical wires with at least one connector attached thereto. Conventionally, the connection cable is made by providing an insulative housing in which a number of channels are defined. Conductive pins are received and retained in the channels with ends of the pins extending beyond the housing. The end of each conductive pin is connected to one of the electrical wires thereby establishing electrical engagement therebetween. The conductive pin is usually manually soldered to the corresponding wire. However, this process results in a low manufacturing efficiency and defective products that leads to high manufacturing costs of the connection cable.

It is thus desirable to have a more efficient electrical connection cable manufacturing method.

SUMMARY OF THE INVENTION

Accordingly, an object of the present invention is to provide an efficient electrical connection cable manufacturing method.

Another object of the present invention is to provide an electrical connection cable manufacturing method that requires a limited amount of manual labor.

A further object of the present invention is to provide an electrical connection cable manufacturing method that produces a connection cable at a reduced cost.

Still another object of the present invention is to provide an electrical connection cable wherein terminal pins of a connector thereof are electrically connected to a conductive core of a wire by a positive displacement technique.

To achieve the above objects, a method for manufacturing an electrical connection cable in accordance with the present invention comprises the steps of (1) providing a first insulator defining a plurality of channels for receiving and retaining conductive pins, a tail section of each pin having a sharpened edge; (2) providing a second insulator defining a plurality of channels for receiving a leading end of an electrical wire, each channel having a slot communicating therewith; and (3) bringing the first and second insulators toward each other whereby the tail ends of the pins are inserted into the corresponding slots of the channels of the second insulator and the sharpened edge of each pin cuts through an insulative sheath of the wire to electrical engage a conductive core thereof.

An electrical connection cable manufactured in accordance with the present invention comprises a cable portion having an end to which a connector portion is mounted. The cable portion comprises at least one electrical wire having a conductive core enclosed by an insulative sheath. The connector portion comprises an insulative housing defining a channel therein corresponding to each of the wires. A leading end of the wire is received in the channel. The connector portion further comprises a conductive pin having a terminal section extending beyond the channel. The conductive pin also comprises a tail section having a sharpened edge cutting through the insulative sheath and physically contacting the conductive core to establish electrical engagement therebetween.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
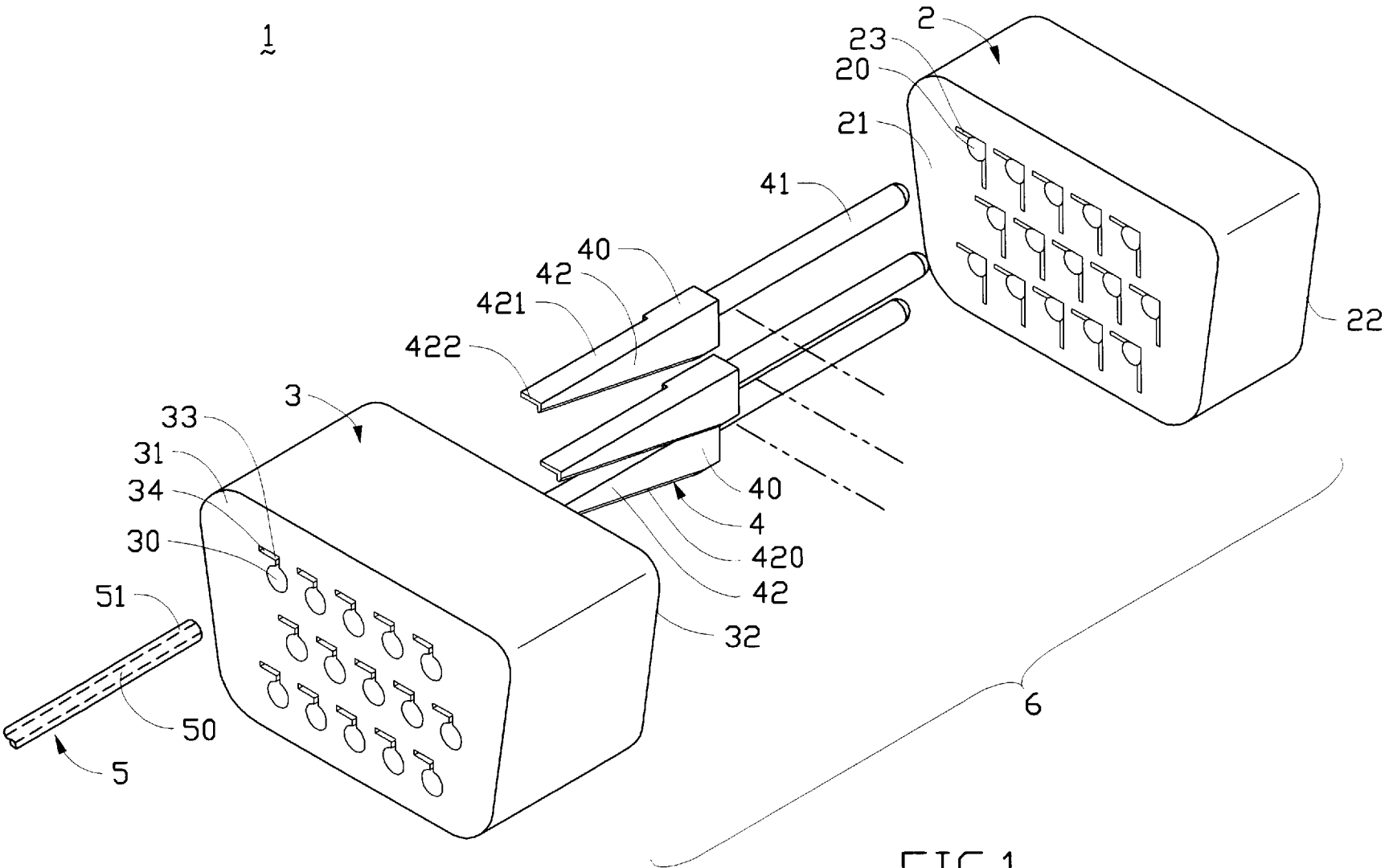
FIG. 1 is an exploded view of an electrical connection cable in accordance with the present invention with a cable portion only partially shown.

Referring to the drawings and in particular to FIG. 1, wherein an electrical connection cable in accordance with the present invention, generally designated by reference numeral 1, is shown, the electrical connection cable 1 comprises a cable portion (not labeled) and a connector portion 6 attached to an end of the cable portion. The cable portion comprises a plurality of wires 5. Each wire 5 comprises a conductive core 50 encased by an insulative sheath 51. It is noted that the cable portion is only partially shown in FIG. 1 and only one wire 5 is illustrated.

The connector portion 6 comprises a first insulator 2 and a second insulator 3. The first insulator 2 has a first face 21 and a second face 22 opposite the first face 21. A plurality of channels 20 are defined between the first and second faces 21, 22 for receiving conductive pins 4.

Figure 3:
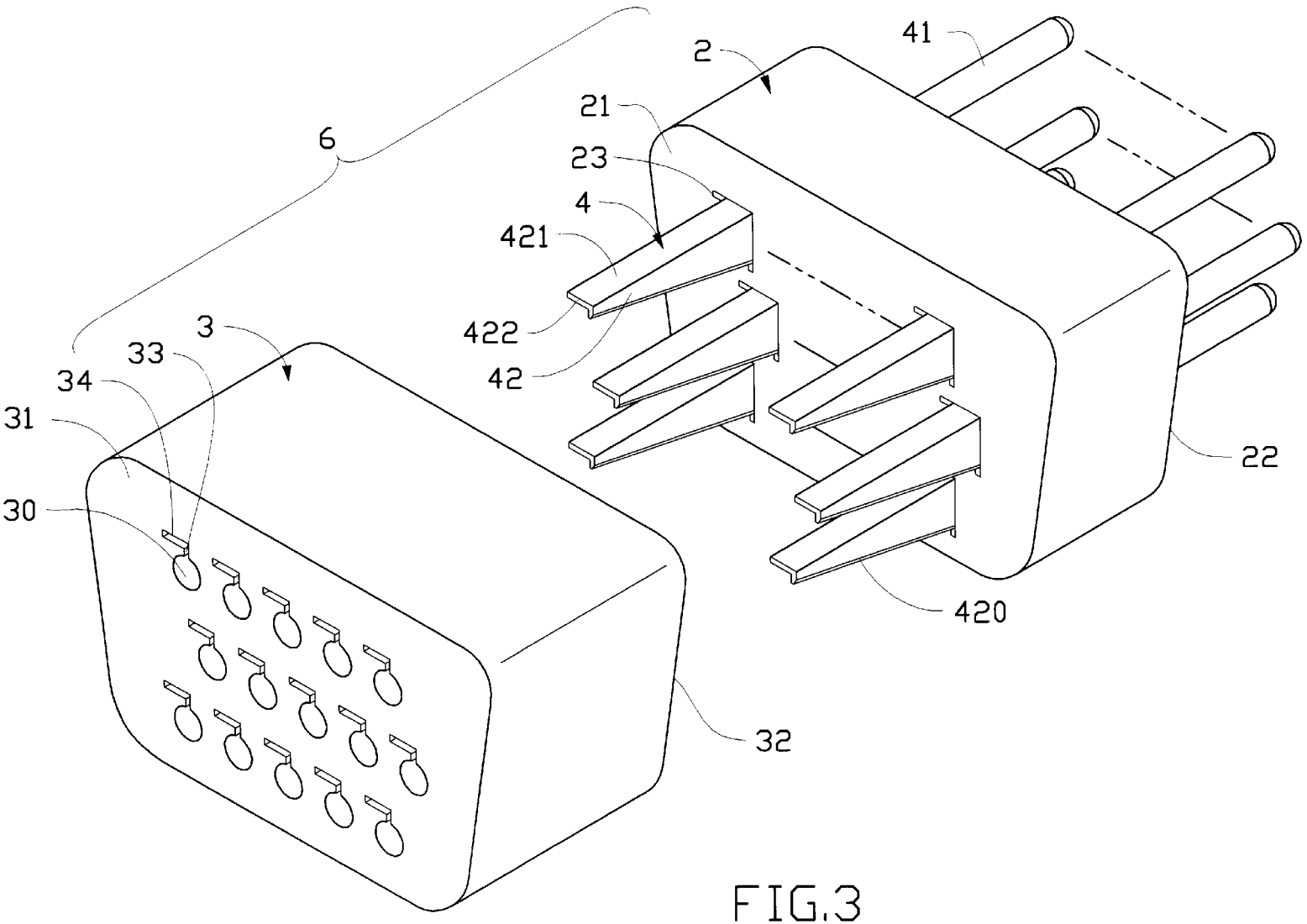
FIG. 3 is a perspective view of a connector portion of the electrical connection cable of the present invention.

Also referring to FIG. 3, the conductive pins 4 comprise an anchoring section 40 received and retained in the corresponding channel 20 of the first insulator 2. A terminal section 41 extends from the anchoring section 40 and projects beyond the second face 22 of the first insulator 2. The terminal section 41 is configured to electrically connect with a mating connector (not shown). The conductive pin 4 also has a tail section 42 extending from the anchoring section 40 in a direction opposite the terminal section 41 and projecting beyond the first face 21 of the first insulator 2. The tail section 42 has an inclined sharpened edge 420 which is tapered toward a free end 422 thereof for cutting through the insulative sheath 51 of the corresponding wire 5 in order to establish electrical engagement with the conductive core 50. This feature will be further described in detail.

The second insulator 3 has a first face 31 and a second face 32 opposite the first face 31. A plurality of channels 30 are defined in the second insulator 3 between the first and second faces 31, 32. Each channel 30 receives a leading end of the corresponding wire 5 therein. The first insulator 2 is brought into contact engagement with the second insulator 3 whereby the first face 21 of the first insulator 2 abuts against the second face 32 of the second insulator 3.

The channel 30 of the second insulator 3 also comprises a first slot 33 in communication therewith. The first slot 33 receives the tail section 42 of the corresponding conductive pin 4 and guides the movement of the tail section 42. The movement of the tail section 42 in the first slot 33 allows the sharpened edge 420 of the tail section 42 of the conductive pin 4 to cut through the insulative sheath 51 of the wire 5 received in the channel 30, thereby electrically engaging the tail section 42 with the conductive core 50 of the wire 5.

Preferably, a reinforcement plate 421 extends from the tail section 42 substantially normal thereto, thereby forming an L-shaped cross section. The reinforcement plate 421 extends from the tail section 42 to the anchoring section 40. To accommodate the reinforcement plate 421, the channel 30 of the second insulator 3 is provided with a second slot 34 communicating with the first slot 33. Similarly, the channel 20 of the first insulator 2 is also provided with a slot 23 for accommodating a portion of the reinforcement plate 421 connected to the anchoring section 40.

Figure 2:
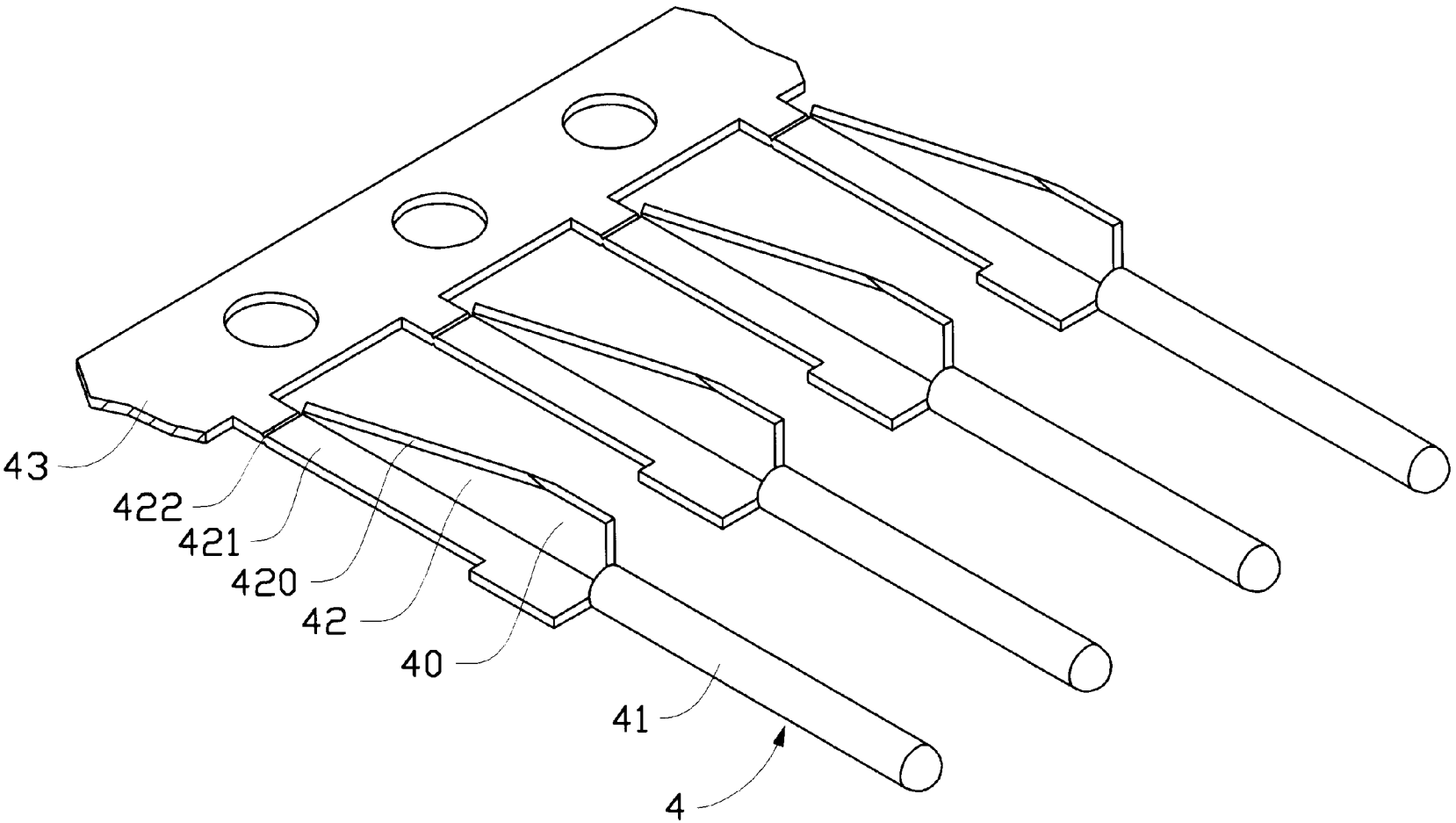
FIG. 2 is a perspective view of a blank of conductive pins of the electrical connection cable of the present invention.

FIG. 2 shows a blank of the conductive pins 4. In accordance with the present invention, the blank comprises a carrier section 43. The conductive pins 4 extend from the carrier section 43 and are spaced from each other. The free end 422 of the tail section 42 each conductive pin of 4 is connected to the carrier section 43. Thus, the terminal section 41 and the anchoring section 40 can be readily inserted into the corresponding channel 20 of the first insulator 2. The carrier section 43 is then removed from the free end 422 of the tail section 42 which is then fit into the corresponding channel 30 of the second insulator 3.

Figure 4A:
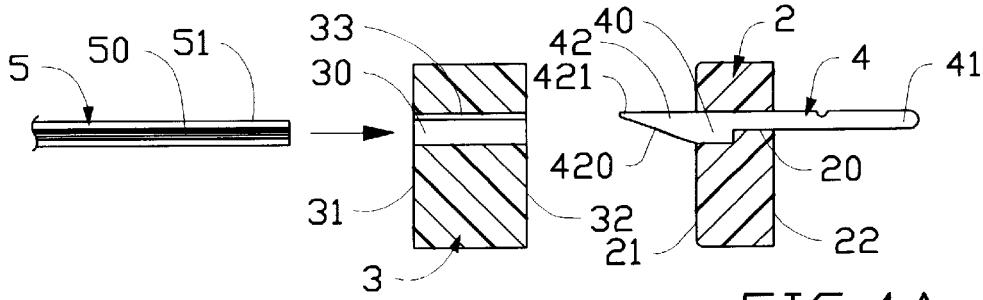
FIGS. 4A–4E are sequential, cross-sectional views of the electrical connection cable manufacturing method in accordance with the present invention.
Figure 4B:
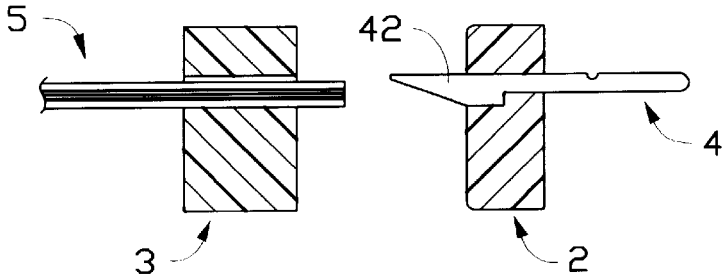
Figure 4C:
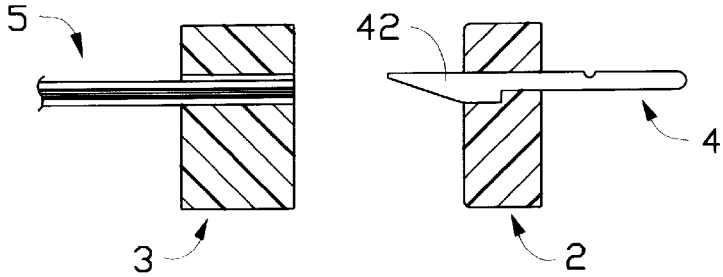
Figure 4D:
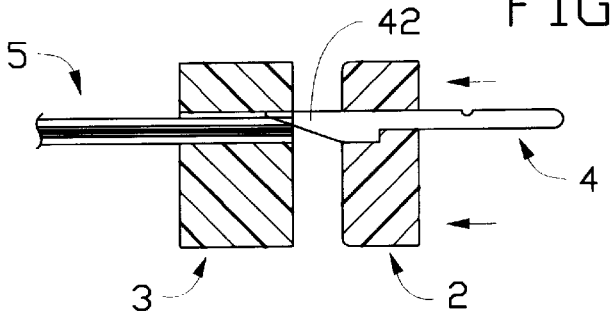
Figure 4E:
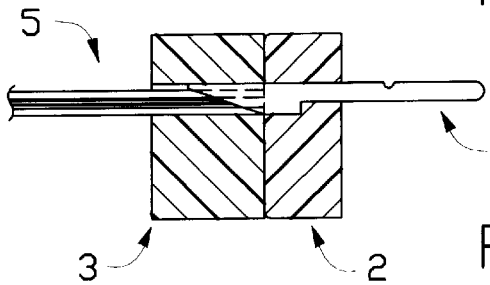

Referring to FIGS. 4A–4E, which show steps of manufacturing the connection cable of the present invention, the conductive pins 4 are inserted into the channels 20 of the first insulator 2 (FIG. 4A) and the wires 5 are inserted into the channels 30 of the second insulator 3 (FIG. 4B). An exposed portion of the wire 5 extending beyond the second face 32 of the second insulator 3 is cut off (FIG. 4C). The first and second insulators 2, 3 are then brought into contact engagement with each other whereby the tail section 42 of the conductive pin 4 is received in the slot 33 of the channel 30 (FIG. 4D). The first face 21 of the first insulator 2 and the second face 32 of the second insulator 3 abut against each other (FIG. 4E) and the sharpened edge 420 of the tail section 42 cuts through the insulative sheath 51 to electrically engage the conductive core 50 of the corresponding wire 5. Thus, the need for soldering the conductive core 50 of the wire 5 to the corresponding conductive pin 4 is eliminated.

Although the present invention has been described with respect to a preferred embodiment, it is obvious that equivalent alterations and modifications will occur to those skilled in the art upon reading and understanding the above detailed description. The present invention includes all such equivalent alterations and modifications and is limited only by the scope of the appended claims.

What is claimed is:

1. An electrical connection cable manufacturing comprising the following steps:

(a) providing a first insulator having a first face and a second face opposite the first face, a plurality of channels being defined between the first and second faces;

(b) providing a plurality of conductive pins, each comprising an anchoring section from which a terminal section and a tail section extend in opposite directions, the tail section forming an angular cross-section with one side having a sharpened edge;

(c) inserting the conductive pins into the corresponding channels of the first insulator whereby the terminal section extends beyond the second face and the tail section extends beyond the first face thereof;

(d) providing a second insulator having a first face and a second face opposite the first face, a plurality of channels being defined between the first and second faces, each of channels having a first slot communicating therewith;

(e) inserting a leading end of a wire into each of the channels of the second insulator; and mating the first face of the first insulator with the second face of the second insulator with the second face of the second insulator wherein the tail sections of the conductive pins are received in the first slots of the channels of the second insulator and the sharpened edges of the conductive pins cut through an insulative sheath of the corresponding wire along a longitudinal direction of the wire to electrically engage a conductive core thereof;

(f) cutting off a portion of the leading of the wire extending beyond the second face of the second insulator; and wherein the tail section of each conductive pin comprises an inclined side on which the sharpened edge is formed and wherein the reinforcement plate extending from the tail section of each conductive pin, the reinforcement plate being substantially normal to the tail section, and wherein the second slots are defined in the first and second insulators in communication with the corresponding channels for receiving the reinforcement plates, said second slots respectively extending through the first and second faces of the first insulator and the first and second faces of the second insulator.

* * * * *